US008887836B2

(12) United States Patent
Williams et al.

(10) Patent No.: US 8,887,836 B2
(45) Date of Patent: Nov. 18, 2014

(54) DRILLING SYSTEMS FOR CLEANING WELLBORES, BITS FOR WELLBORE CLEANING, METHODS OF FORMING SUCH BITS, AND METHODS OF CLEANING WELLBORES USING SUCH BITS

(75) Inventors: Adam R. Williams, Conroe, TX (US); Chad T. Jurica, Spring, TX (US); Matthew J. Meiners, Conroe, TX (US); Jason Coe, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 584 days.

(21) Appl. No.: 12/424,381

(22) Filed: Apr. 15, 2009

(65) Prior Publication Data

US 2010/0263875 A1 Oct. 21, 2010

(51) Int. Cl.
*E21B 10/00* (2006.01)
*E21B 37/02* (2006.01)
*E21B 7/20* (2006.01)

(52) U.S. Cl.
CPC .. *E21B 37/02* (2013.01); *E21B 7/20* (2013.01)
USPC ..... 175/327; 175/402

(58) Field of Classification Search
USPC ..... 175/327, 311, 344, 345, 348, 379, 385, 175/399, 402, 406, 391, 171, 61
See application file for complete search history.

(56) References Cited

U.S. PATENT DOCUMENTS 2,021,184 A * 11/1935 Hill ..... 285/333
2,177,866 A * 10/1939 Catland ..... 384/92
3,175,629 A * 3/1965 Rowley ..... 175/340
4,696,354 A * 9/1987 King et al. ..... 175/430
5,035,293 A * 7/1991 Rives ..... 175/57
5,199,511 A * 4/1993 Tibbitts et al. ..... 175/65
5,330,016 A * 7/1994 Paske et al. ..... 175/320
5,601,151 A * 2/1997 Warren ..... 175/75
5,711,205 A * 1/1998 Wolfer et al. ..... 92/155
5,836,404 A * 11/1998 Trujillo et al. ..... 175/57
5,957,225 A * 9/1999 Sinor ..... 175/57
6,062,326 A * 5/2000 Strong et al. ..... 175/402

(Continued)

FOREIGN PATENT DOCUMENTS

WO WO 2004029402 A1 * 4/2004 ..... E21B 10/30

OTHER PUBLICATIONS

International Search Report for International Application No. PCT/US2010/031193 dated Nov. 26, 2010, 3 pages.

(Continued)

*Primary Examiner* — David Bagnell
*Assistant Examiner* — Ronald Runyan
(74) *Attorney, Agent, or Firm* — Steve Rosenblatt

(57) ABSTRACT

Wellbore cleaning bits include a bit body, at least one cutting structure on the bit body, and a shank configured to attach the bit body to a drill string. Drilling systems for cleaning wellbores include a wellbore cleaning bit coupled to a drill string. The wellbore cleaning bit may include a casing bit body and a shank attached to the casing bit body and the drill string. A casing bit may be attached to a shank having a connection portion configured for attachment to a drill string to form wellbore cleaning bits for cleaning at least a section of a wellbore. Furthermore, a casing bit may be advanced into a wellbore using a drill string to clean a wellbore.

16 Claims, 3 Drawing Sheets

(56) References Cited

U.S. PATENT DOCUMENTS

| | | | | |
|---|---|---|---|---|
| 6,401,820 | B1 * | 6/2002 | Kirk et al. | 166/311 |
| 6,443,247 | B1 * | 9/2002 | Wardley | 175/402 |
| 6,659,173 | B2 * | 12/2003 | Kirk et al. | 166/242.8 |
| 6,983,811 | B2 * | 1/2006 | Wardley | 175/402 |
| 7,066,253 | B2 * | 6/2006 | Baker | 166/242.8 |
| 7,117,960 | B2 * | 10/2006 | Wheeler et al. | 175/171 |
| 7,216,727 | B2 * | 5/2007 | Wardley | 175/402 |
| 7,395,882 | B2 * | 7/2008 | Oldham et al. | 175/402 |
| 7,621,351 | B2 * | 11/2009 | Clark et al. | 175/394 |
| 7,896,110 | B2 * | 3/2011 | Bain | 175/402 |
| 7,900,703 | B2 * | 3/2011 | Clark et al. | 166/298 |
| 2002/0096368 | A1 * | 7/2002 | Kirk et al. | 175/385 |
| 2004/0040751 | A1 * | 3/2004 | Falvey et al. | 175/415 |
| 2004/0206552 | A1 | 10/2004 | Beaton | |
| 2004/0245020 | A1 * | 12/2004 | Giroux et al. | 175/61 |
| 2006/0054355 | A1 | 3/2006 | Larsen et al. | |
| 2007/0187149 | A1 * | 8/2007 | Kristensen et al. | 175/57 |
| 2007/0289782 | A1 * | 12/2007 | Clark et al. | 175/406 |
| 2008/0066581 | A1 * | 3/2008 | Zahradnik et al. | 76/108.4 |
| 2010/0252331 | A1 * | 10/2010 | High et al. | 175/320 |

OTHER PUBLICATIONS

International Written Opinion for International Application No. PCT/US2010/031193 dated Nov. 26, 2010, 5 pages.

Baker Oil Tools, Baker Drill Down Float shoe and other documents pertaining to cutting structures on the OD of a float shoe, 6 pages, May 23, 1997.

Caledus Ltd., BridgeBUSTER® Product Information Sheet, 3 pages, 2004.

Davis-Lynch, Inc./Downhole Products plc, Pen-o-trator™, 2 pages.

Ray Oil Tool, The Silver Bullett Float Shoes & Collars, 2 pages.

Weatherford Cementation Products, BBL Reamer Shoes™, 3 pages. 1998.

* cited by examiner

DRILLING SYSTEMS FOR CLEANING WELLBORES, BITS FOR WELLBORE CLEANING, METHODS OF FORMING SUCH BITS, AND METHODS OF CLEANING WELLBORES USING SUCH BITS

TECHNICAL FIELD

Embodiments of the present invention relate to drilling systems, tools, and methods for use in forming wellbores in subterranean earth formations.

BACKGROUND

Wellbores are formed in subterranean formations for various purposes including, for example, extraction of oil and gas from the subterranean formation and extraction of geothermal heat from the subterranean formation. A wellbore may be formed in a subterranean formation using a drill bit such as, for example, an earth-boring rotary drill bit. Different types of earth-boring rotary drill bits are known in the art including, for example, fixed-cutter bits (which are often referred to in the art as "drag" bits), rolling-cutter bits (which are often referred to in the art as "rock" bits), diamond-impregnated bits, and hybrid bits (which may include, for example, both fixed cutters and rolling cutters). The drill bit is rotated and advanced into the subterranean formation. As the drill bit rotates, the cutters or abrasive structures thereof cut, crush, shear, and/or abrade away the formation material to form the wellbore. A diameter of the wellbore drilled by the drill bit may be defined by the cutting structures disposed at the largest outer diameter of the drill bit.

The drill bit is coupled, either directly or indirectly, to an end of what is referred to in the art as a "drill string," which comprises a series of elongated tubular segments connected end-to-end that extends into the wellbore from the surface of the formation. Various tools and components, including the drill bit, may be coupled together at the distal end of the drill string at the bottom of the wellbore being drilled. This assembly of tools and components is referred to in the art as a "bottom hole assembly" (BHA).

The drill bit may be rotated within the wellbore by rotating the drill string from the surface of the formation, or the drill bit may be rotated by coupling the drill bit to a downhole motor, which is also coupled to the drill string and disposed proximate the bottom of the wellbore. The downhole motor may comprise, for example, a hydraulic Moineau-type motor having a shaft, to which the drill bit is mounted, that may be caused to rotate by pumping fluid (e.g., drilling mud or fluid) from the surface of the formation down through the center of the drill string, through the hydraulic motor, out from nozzles in the drill bit, and back up to the surface of the formation through the annular space between the outer surface of the drill string and the exposed surface of the formation within the wellbore.

It is known in the art to use what are referred to in the art as a "reamer" devices (also referred to in the art as "hole opening devices" or "hole openers") in conjunction with a drill bit as part of a bottom hole assembly when drilling a wellbore in a subterranean formation. In such a configuration, the drill bit operates as a "pilot" bit to form a pilot bore in the subterranean formation. As the drill bit and bottom hole assembly advances into the formation, the reamer device follows the drill bit through the pilot bore and enlarges the diameter of, or "reams," the pilot bore.

After drilling a wellbore in a subterranean earth-formation, it may be desirable to line the wellbore with sections of casing or liner. Casing is relatively large diameter pipe (relative to the diameter of the drill pipe of the drill string used to drill a particular wellbore) that is assembled by coupling casing sections in an end-to-end configuration. Casing is inserted into a previously drilled wellbore, and is used to seal the walls of the subterranean formations within the wellbore. The casing then may be perforated at one or more selected locations within the wellbore to provide fluid communication between the subterranean formation and the interior of the wellbore. Casing may be cemented in place within the wellbore. The term "liner" refers to a casing string that does not extend to the top of a wellbore, but instead is anchored or suspended from inside the bottom of a casing string previously placed within the wellbore.

As casing is advanced into a wellbore, it is known in the art to secure a casing bit to the distal end of the distal casing section in the casing string (the leading end of the casing string as it is advanced into the wellbore). As used herein, the term "distal" means distal to the earth surface into which the wellbore extends (i.e., the end of the wellbore at the surface), while the term "proximal" means proximal to the earth surface into which the wellbore extends. The casing string, with the casing bit attached thereto, optionally may be rotated in tandem with the casing bit as the casing is advanced into the wellbore. In some instances, the casing bit may be configured as what is referred to in the art as a casing "shoe" which is primarily configured to guide the casing into the wellbore and ensure that no obstructions or debris are in the path of the casing, and to ensure that no debris is allowed to enter the interior of the casing as the casing is advanced into the wellbore. In other instances, the casing bit may be configured as a reaming bit, which serves the same purposes of a casing shoe, but is further configured for reaming (i.e., enlarging) the diameter of the wellbore as the casing is advanced into the wellbore. It is also known to employ casing bits that are configured as drill bits for drilling a wellbore. Drilling a wellbore with such a drill bit attached to casing is referred to in the art as "drilling with casing." As used herein, the term "casing bit" means and includes any type of end cap structure configured for attachment to a distal end of casing as the casing is advanced into a wellbore, and includes, for example, casing shoes, casing reamers, and casing drill bits.

There are instances, however, in which it is desirable to perform what is referred to in the art as a "cleaning" (or "polishing") process within a previously drilled wellbore prior to positioning casing within the wellbore. As used herein, the phrases "cleaning a wellbore" and "cleaning a section of a wellbore" mean advancing a device (e.g., a bit) through at least a section of a previously drilled wellbore to ensure that the section of the wellbore is at least substantially free of obstructions and has a diameter at least as large as a diameter of the device. In some instances, it may not be feasible or practical to rotate casing as the casing is advanced into a wellbore, and, hence, it is important to ensure that the wellbore is clean prior to advancing the casing into the wellbore. Thus, some drilling operators use a drill string to run a drill bit used to initially drill the wellbore into the wellbore one or more additional times to clean the wellbore. Such processes, however, may be subject to the risk of the drill bit veering off from the initial wellbore (i.e., sidetracking) and starting to form another wellbore.

There remains a need in the art for drilling systems, bits, and methods that may be used for cleaning previously drilled wellbores.

BRIEF SUMMARY OF THE INVENTION

In some embodiments, the present invention includes wellbore cleaning bits for cleaning wellbores. The cleaning bits include a bit body, at least one cutting structure on the bit body, and a shank attached to the bit body. A distal end of the shank may be attached to a proximal end portion of the bit body, and a proximal end of the shank may be configured for attachment to a drill string.

In additional embodiments, the present invention includes drilling systems for cleaning wellbores. The drilling systems include a drill string and a wellbore cleaning bit coupled to the drill string. For example, the drill string may comprise at least two sections of drill pipe coupled end-to-end, and the wellbore cleaning bit may be coupled to a distal end of the drill string. The wellbore cleaning bit includes a casing bit body and a shank attached to the casing bit body. A distal end of the shank is attached to a proximal end of the casing bit body, and a proximal end of the shank is attached to the distal end of the drill string.

In additional embodiments, the present invention includes methods of forming wellbore cleaning bits that may be used to clean at least a section of a wellbore. The methods may include attaching a casing bit to a shank having a connection portion configured for attachment to a drill string.

In yet further embodiments, the present invention includes methods of cleaning wellbores in which a casing bit is advanced into a wellbore using a drill string.

BRIEF DESCRIPTION OF THE SEVERAL VIEWS OF THE DRAWINGS

While the specification concludes with claims particularly pointing out and distinctly claiming that which is regarded as the present invention, various features and advantages of this invention may be more readily ascertained from the following description of embodiments of the invention when read in conjunction with the accompanying drawings, in which:

DETAILED DESCRIPTION OF THE INVENTION

In the description which follows, elements common between figures may retain the same numerical designation.

As used herein the term "drill string" means and includes a series of elongated tubular segments connected end-to-end that extends into the wellbore, the elongated tubular segments having outer diameters smaller than a diameter of the wellbore to provide an annular space within the wellbore exterior to the tubular segments.

As used herein, the term "casing" means and includes relatively large diameter pipe (relative to the diameter of the drill pipe of the drill string used to drill a particular wellbore) that is assembled by coupling casing sections in an end-to-end configuration that is positioned within a previously-drilled wellbore and that remains within the wellbore after completion of the wellbore to seal walls of the subterranean formations within the wellbore. Furthermore, the term casing includes wellbore casing and casing sections as well as wellbore liner and liner sections.

As used herein, the term "casing bit" means and includes any bit that is designed and configured for attachment to casing, as opposed to conventional "drill bits" which are designed and configured for attachment to drill string. Furthermore, casing bits are designed and configured to remain within a wellbore after completion of the wellbore (although casing bits may be drilled through by another bit after they are positioned within a wellbore), while conventional drill bits are designed and configured to be removed from a wellbore prior to completion of the wellbore.

Embodiments of the present invention may be used for cleaning a previously drilled wellbore to ensure that the diameter of the wellbore within at least a particular section of the wellbore is at least substantially free of obstructions and has a diameter large enough to receive casing therein.

In some embodiments, the present invention includes wellbore cleaning bits that include a casing bit attached to a shank having a connection portion configured for attachment to a drill string. For example, embodiments of wellbore cleaning bits of the present invention may comprise a shank having a first end comprising a connection portion configured for attachment to a drill string, and a second, opposite end configured for attachment to a body of a casing bit, which may have been designed and configured for attachment to a section of casing. Thus, in accordance with additional embodiments of the present invention, casing bits that may have been designed, configured, and/or fabricated for attachment to casing may be adapted, using embodiments of shanks of the present invention, for attachment to a drill string. The resulting wellbore cleaning bits may be used to clean a previously drilled wellbore in preparation for receiving casing therein.

Figure 1:
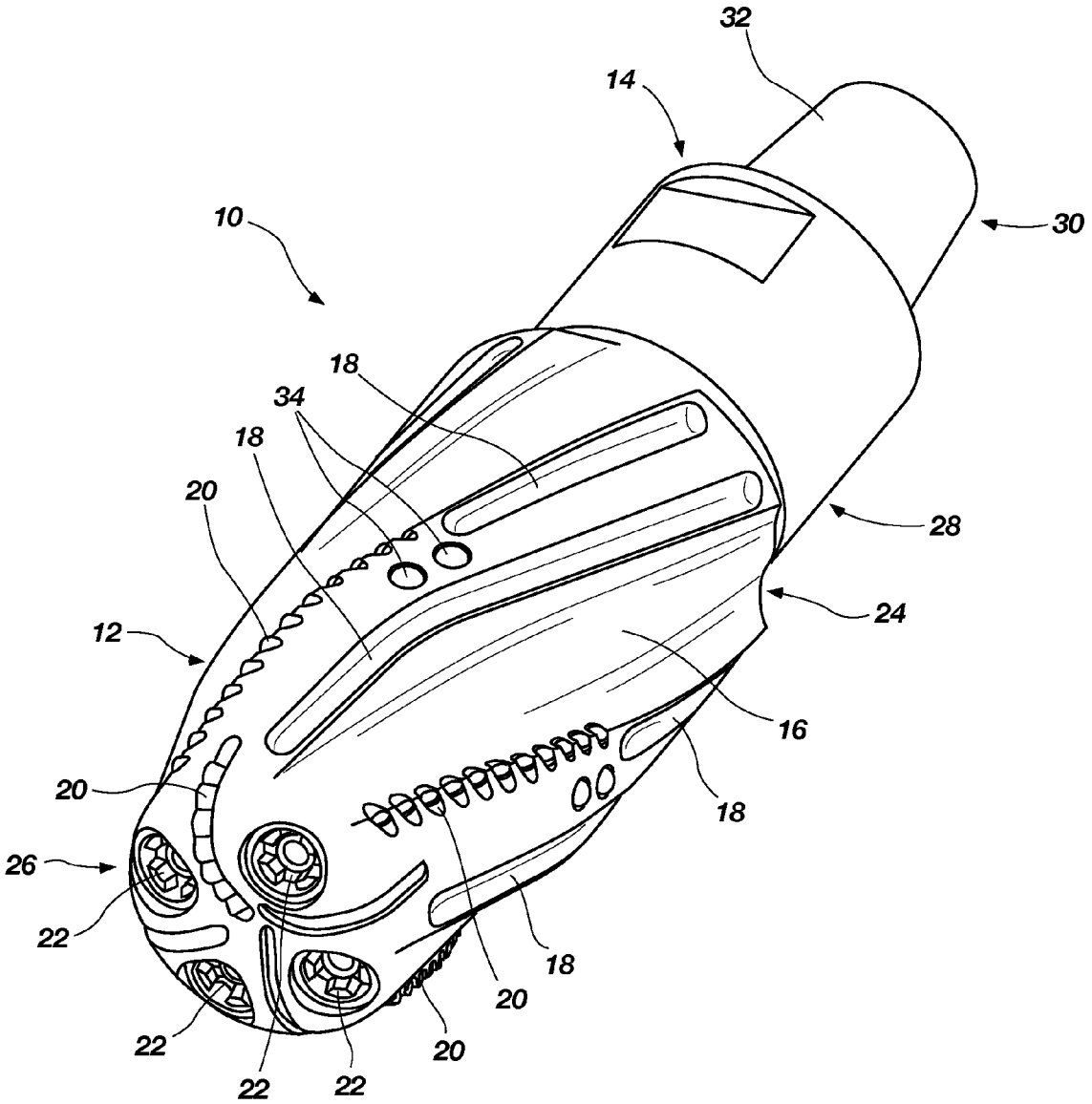
FIG. 1 is a perspective view of an embodiment of a wellbore cleaning bit of the present invention.

FIG. 1 is a perspective view of an embodiment of a wellbore cleaning bit 10 of the present invention. The wellbore cleaning bit 10 includes a bit 12 and a shank 14. In some embodiments, the bit 12 may have been designed, configured, and/or fabricated for attachment to an end of a section of wellbore casing. In other words, the bit 12 may comprise a casing bit. By way of example and not limitation, in some embodiments, the bit 12 may comprise a casing bit as described in U.S. patent application Ser. No. 11/747,651, which was filed May 11, 2007 and entitled Reaming Tool Suitable For Running On Casing Or Liner And Method Of Reaming, now U.S. Pat. No. 7,621,351, issued Nov. 24, 2009, or as described in U.S. Pat. No. 7,395,882 B2, which issued on Jul. 8, 2008 to Oldham et al., each of which is incorporated herein in its entirety by this reference. The cleaning bit 10 is attached, however, to the shank 14, which is configured for attaching the cleaning bit 10 to an end of a section of drill pipe of a drill string (not shown), instead of to a section of casing. In other embodiments of the invention, the bit 12 may be designed, configured, and/or fabricated specifically for attachment to a drill string and for use as a wellbore cleaning bit.

As shown in FIG. 1, the bit 12 comprises a body 16. Structures for cutting and/or reaming may be provided on the exterior surface of the body 16 of the bit 12. For example, one or more deposits of hardfacing material 18 may be provided on the exterior surface of the body 16. As used herein, the term "hardfacing material" means and includes any material deposited over (e.g., on) another material and that exhibits higher wear resistance (e.g., at least one of abrasion resistance and erosion resistance) relative to the another material over which it is deposited. Hardfacing materials often include hard particles (e.g., particles of diamond, particles of ceramic carbides, borides, or nitrides (e.g., tungsten carbide), etc.) embedded within a metal alloy matrix material (often referred to in the art as a "binder" material). Hardfacing materials are often deposited using a welding process or a flame spray process.

Additionally, one or more cutting elements 20 may be provided on the exterior surface of the body 16. In some embodiments, the cutting elements 20 may comprise bodies that are formed separately from the body 16 of the bit 12 and subsequently attached thereto. The cutting elements 20 have a shape configured to cut material (e.g., formation material, cement, metal, etc.) as the bit 12 is rotated within a wellbore. Many configurations of cutting elements are known in the art and may be employed in embodiments of the present invention. In some embodiments, one or more of the cutting elements 20 may comprise a substantially cylindrical body of relative hard and wear resistant material such as, for example, tungsten carbide. In additional embodiments, one or more of the cutting elements 20 may comprise what is referred to in the art as a polycrystalline diamond compact (PDC) cutting element. Such PDC cutting elements include a polycrystalline diamond material, often in the form of a relatively thin layer (a "diamond table") on an end of a generally cylindrical body, which is often formed of cemented tungsten carbide material. In yet further embodiments, one or more of the cutting elements may comprise tungsten carbide compact cutting elements such as those sold by Baker Hughes Incorporated of Houston, Tex. under the trademark METAL MUNCHER cutting elements. Such cutting elements may be configured to facilitate cutting through metal materials.

Combinations of the different types of cutting elements 20 described above also may be provided on the body 16 of the bit 12. For example, in the embodiment shown in FIG. 1, the cutting elements 20 in the relatively shorter rows of cutting elements 20 at the distal end of the bit 12 may comprise tungsten carbide compact cutting elements such as those sold by Baker Hughes Incorporated of Houston, Tex. under the trademark METAL MUNCHER, and the cutting elements 20 in the relatively longer rows of cutting elements 20 extending along the lateral sides of the bit 12 may comprise PDC cutting elements configured for drilling earth formations.

Although not shown in the figures, the drill bit 10 may further comprise additional cutting elements configured for back reaming. Such cutting elements may be positioned on a proximal end 24 of the body 16 of the bit 12.

An internal plenum (not visible in FIG. 1) may extend at least partially through the body 16 of the bit 12, and fluid passageways may extend through the body 16 to provide fluid communication between the internal plenum and the exterior of the bit 12. As shown in FIG. 1, nozzles 22 may be secured within the fluid passageways and used to selectively tailor the hydraulic characteristics of the bit 12 (e.g., the velocity of fluid flowing out from the fluid passageways to the exterior of the bit 12 during a wellbore cleaning operation).

In some embodiments, the body 16 of the bit 12 may be predominately comprised of a metal alloy such as, for example, an iron-based metal alloy (e.g., steel). Optionally, the metal alloy may comprise a relatively softer metal alloy such as those commonly used for casing bits, which are often required to be soft enough to allow another drill bit to drill through the casing bit (from the interior to the exterior thereof) after the casing bit is used to position casing within a wellbore. For example, the body of the bit 12 may comprise an aluminum-based or a copper-based metal alloy in some embodiments. Other materials that may be used to form the body 16 of the bit 12 are described in, for example, U.S. Pat. No. 7,395,882, which issued Jul. 8, 2008 to Oldham et al. In additional embodiments, the body 16 of the bit 12 may comprise a relatively more wear-resistant composite material such as, for example, a composite material including a plurality of hard particles (e.g., particles of diamond, particles of ceramic carbides, borides, or nitrides (e.g., tungsten carbide), etc.) embedded within a metal alloy matrix material such as, for example, a copper-based metal alloy, an iron-based metal alloy, a nickel-based metal alloy, or a cobalt-based metal alloy.

The body 16 of the bit 12 may be configured so as to prevent side-tracking of the bit 12 as the bit 12 is advanced through a wellbore. By way of example and not limitation, a distal end 26 of the body 16 of the bit 12 may comprise a leading section having a reduced diameter relative to the maximum diameter of the body 16 of the bit 12. The maximum diameter of the body 16 of the bit 12 may be defined at generally within a longitudinal midsection of the body 16. Thus, as the bit 12 is advanced through a previously drilled wellbore, the leading section of reduced diameter will tend to follow the path of the previously drilled wellbore, thereby reducing the likelihood that the bit 12 will side-track from the previously drilled wellbore. Furthermore, the average aggressiveness of the cutting elements 20 of the cleaning bit 10 may be reduced relative to the average aggressiveness of cutting elements on drill bits used for drilling wellbores. For example, the average back rake angle of the cutting elements 20 of the cleaning bit 10 may be relatively higher (e.g., about 20° or more, or even about 25° or more) than the average back rake angle of the cutting elements on drill bits conventionally used for drilling wellbores. As another example, the average exposure of the cutting elements 20 of the cleaning bit 10 may be relatively lower than the average exposure of cutting elements on drill bits conventionally used for drilling wellbores.

Wear-resistant inserts 34 also may be provided on the body 16 of the bit 12. The wear-resistant inserts 34 may be configured to rub against the surfaces of the formation within the wellbore as the cleaning bit 10 is advanced through the wellbore. The wear-resistant inserts 34 may be configured to limit a depth of cut of the cutting elements 20 and/or reduce wearing of the body 16 of the bit 12.

Figure 2:
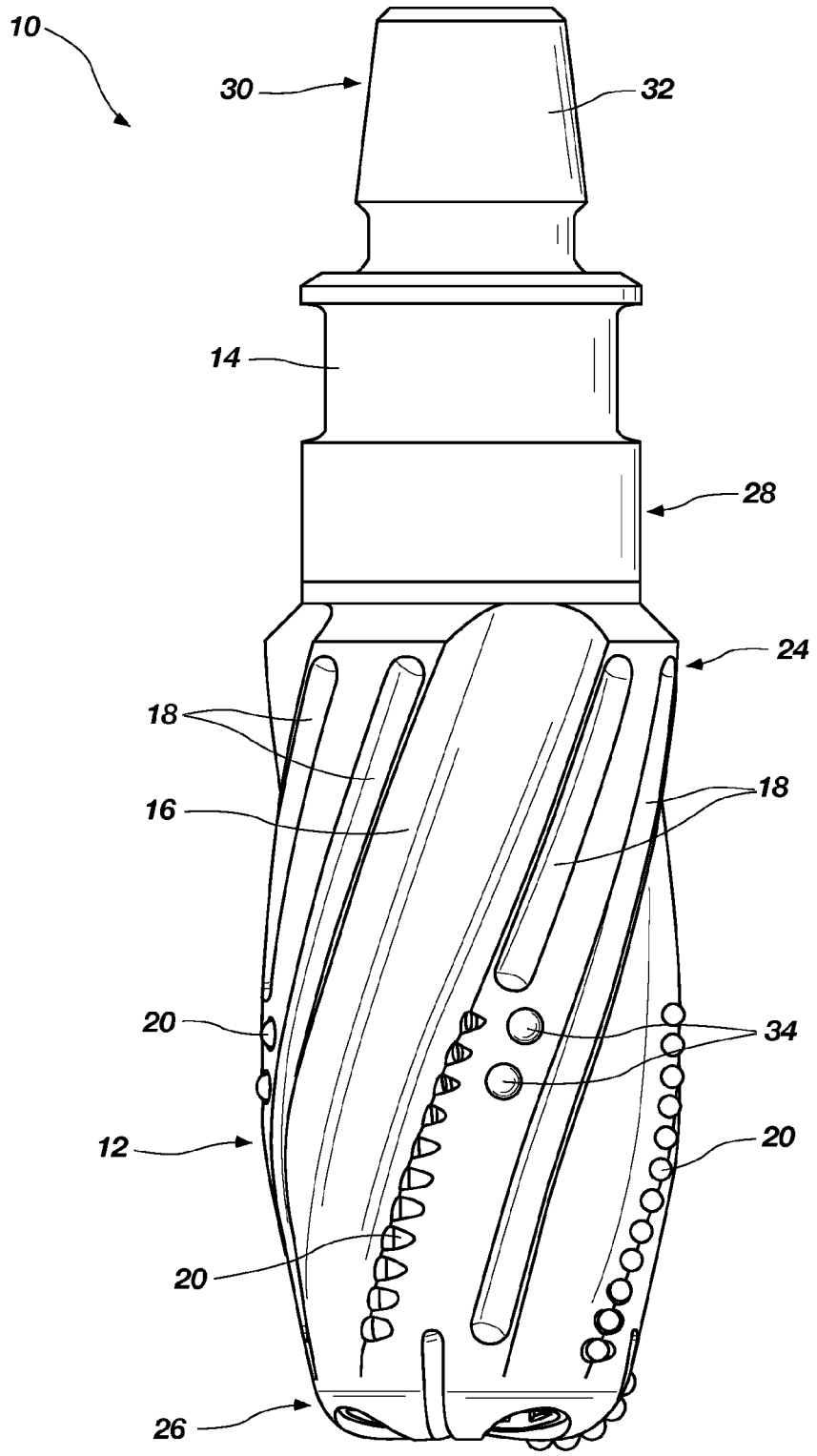
FIG. 2 is a side view of the wellbore cleaning bit of FIG. 1.

The shank 14 has a generally tubular, cylindrical shape. The shank 14 may be predominately comprised of a metal alloy such as, for example, an iron-based metal alloy (e.g., steel). Referring to FIG. 2, a distal end 28 of the shank 14 is attached to a proximal portion of the body 16 of the bit 12, and a proximal end 30 of the shank 14 is configured for attachment to a drill string. By way of example, the proximal end 30 of the shank 14 may comprise a threaded pin 32. The threaded pin 32 comprises a male pin having at least one thread on an outer surface thereof and extending circumferentially about the pin. The threaded pin 32 may conform to industry standards, such as, for example, those promulgated by the American Petroleum Institute (API). The threaded pin 32 may be configured to thread into a threaded box on a distal end of a section of drill pipe (not shown), thereby coupling the shank 14 (and the bit 12 attached thereto) to the drill pipe.

Figure 3:
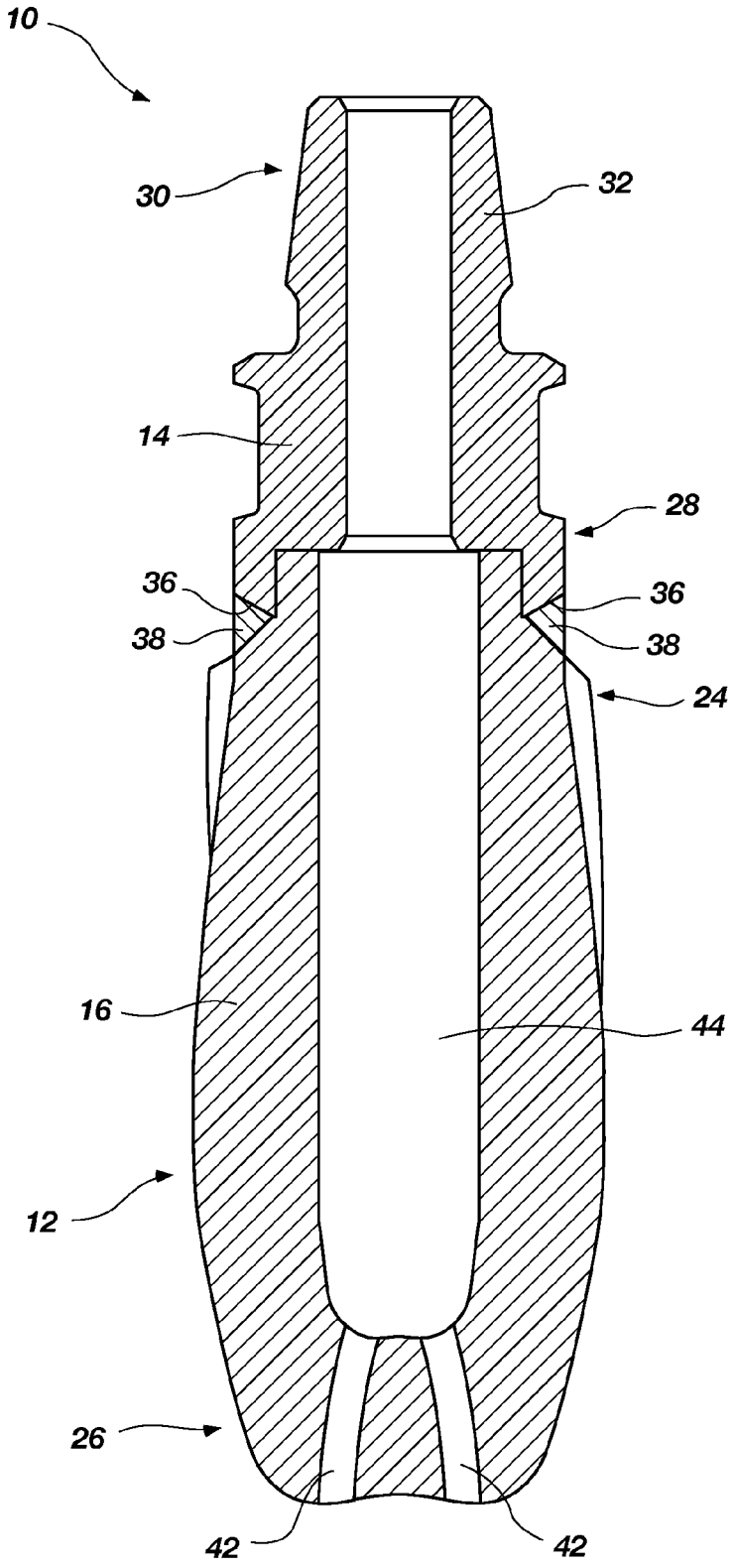
FIG. 3 is a cross-sectional view of the wellbore cleaning bit of FIGS. 1 and 2.

FIG. 3 is a cross-sectional view of the wellbore cleaning bit of FIGS. 1 and 2. As shown in FIG. 3, a proximal end 24 of the body 16 of the bit 12 is may be attached to a distal end 28 of the shank 14, as previously mentioned. In some embodiments, the proximal end 24 of the body 16 of the bit 12 may be welded to the distal end 28 of the shank. For example, a weld may be formed along an interface between the body 16 of the bit 12 and the shank 14 on the exterior of the cleaning bit 10. In some embodiments, the proximal end 24 of the body 16 and the distal end 28 of the shank 14 each may be configured to form a weld groove 36 therebetween when the body 16 of the bit 12 is abutted against the shank 14 in preparation for welding. The weld groove 36 may extend circumferentially about the cleaning bit 10 along the interface between the bit 12 and the shank 14. During the welding process, a filler material 38 may be deposited in the weld groove 36 in the form of a weld bead. A plurality of weld passes may be performed around the cleaning bit 10 to fill the weld groove 36 with the filler material 38 deposited in the form of weld beads during the welding passes.

In additional embodiments, cooperating, complementary threads may be formed on surfaces of the body 16 of the bit 12 and the shank 14 to allow the shank 14 and the bit 12 to be threaded together to couple the bit 12 to the shank 14.

As shown in FIG. 3, the body 16 of the bit 12 may be hollow. In embodiments in which the bit 12 comprises a casing bit, the wall of the body 16 may be relatively thin when compared to conventional fixed-cutter earth-boring rotary drill bits configured for attachment to a drill string.

In some embodiments, the thickness of the wall of the body 16 may vary between about five percent (5%) and about forty percent (40%) of the diameter of the bit 12. For example, in some embodiments, the thickness of the wall of the body 16 may vary between about five percent (5%) and about twenty percent (20%) of the diameter of the bit 12, or even between about five percent (5%) and about fifteen percent (15%) of the diameter of the bit 12. In additional embodiments, the thickness of the wall of the body 16 may vary between about twenty percent (20%) and about forty percent (40%) of the diameter of the bit 12. Furthermore, an inner surface of the wall of the body 16 in such embodiments may have a shape configured that would facilitate drilling through the wall of the body 16 by a drill bit if the bit 16 bit 12 were used to guide casing into a wellbore and subsequently drilled through by another drill bit.

As shown in FIG. 3, a plurality of fluid passageways 42 may be formed through the body 16 of the bit 12 to allow drilling fluid to be pumped through the bit 12 from an interior fluid plenum 44 to the exterior of the bit 12 as the cleaning bit 12 is being used to clean a wellbore.

Embodiments of cleaning bits of the present invention, such as, for example, the cleaning bit 10 shown in FIGS. 1 through 3 may be formed in accordance with embodiments of methods of the present invention. In some embodiments, embodiments of the present invention include forming a cleaning bit from a casing bit or a body of a casing bit. A casing bit may be designed, configured, and/or fabricated for attachment to a section of casing, but instead of attaching the casing bit to a section of casing, the casing bit may be adapted for attachment to a drill string. For example, a shank 14 as previously described herein may be provided (e.g., formed by machining a tubular steel body), and a casing bit or a body of a casing bit may be attached to the shank 14 to form a cleaning bit 10.

Embodiments of cleaning bits of the present invention, such as, for example, the cleaning bit 10 shown in FIGS. 1 through 3 may be used to clean a wellbore in preparation for receiving casing therein. For example, after drilling a wellbore with a conventional earth-boring rotary drill bit, the conventional earth-boring rotary drill bit may be tripped out from the wellbore. A cleaning bit 10 as previously described herein may be coupled to the distal end of a drill string and advanced into the previously-drilled wellbore. The cleaning bit 10 may be advanced through at least a section of the wellbore while rotating the cleaning bit 10 (by at least one of rotating the drill string and using a down-hole motor) and pumping drilling fluid from the surface down the wellbore through the interior of the drill string, through the cleaning bit 10, and back up the wellbore through an annular space surrounding the drill string within the wellbore back to the surface. As the cleaning bit 10 is thus advanced through the wellbore, the wellbore may be cleaned and otherwise prepared for receiving casing therein.

Although the foregoing description contains many specifics, these are not to be construed as limiting the scope of the present invention, but merely as providing certain exemplary embodiments. Similarly, other embodiments of the invention may be devised which do not depart from the spirit or scope of the present invention. The scope of the invention is, therefore, indicated and limited only by the appended claims and their legal equivalents, rather than by the foregoing description. All additions, deletions, and modifications to the invention, as disclosed herein, which fall within the meaning and scope of the claims are encompassed by the present invention.

What is claimed is:

1. A wellbore cleaning bit for cleaning at least a section of a wellbore, the wellbore cleaning bit comprising:

a casing monolithic bit body having a proximal end portion configured for attachment to an end of a section of wellbore casing for tandem rotation therewith and further comprising a distal end portion which further comprises a distal end surface through which a longitudinal axis extends and a largest dimension located between said proximal and distal end portions to minimize sidetracking while cleaning the wellbore;

at least one cutting structure on an exterior surface of the casing bit body, which extends in a generally axial direction in multiple rows of cutters from said distal end surface to and beyond said largest dimension; and a shank comprising:

a distal end attached to a proximal end portion of the casing bit body; and a proximal end configured for attachment to a drill string.

2. The wellbore cleaning bit of claim 1, wherein the at least one cutting structure comprises at least one of a deposit of hardfacing material and a separately formed cutting element.

3. The wellbore cleaning bit of claim 1, wherein the at least one cutting structure comprises at least one tungsten carbide compact cutting element.

4. The wellbore cleaning bit of claim 1, wherein the distal end of the shank is welded to the proximal end portion of the casing bit body.

5. The wellbore cleaning bit of claim 1, wherein the casing bit body comprises a wall having a wall thickness varying between about five percent (5%) and about forty percent (40%) of a largest diameter of the casing bit body.

6. The wellbore cleaning bit of claim 5, wherein the casing bit body comprises a wall having a wall thickness varying between about five percent (5%) and about fifteen percent (15%) of a largest diameter of the casing bit body.

7. The wellbore cleaning bit of claim 6, wherein the casing bit body comprises a wall having an interior surface having a shape configured to facilitate drilling through the casing bit body by another drill bit.

8. The wellbore cleaning bit of claim 1, wherein the proximal end of the shank comprises a threaded pin.

9. A drilling system for cleaning at least a section of a wellbore, the system comprising:

a drill string comprising at least two sections of drill pipe coupled end-to-end; and a wellbore cleaning bit coupled to a distal end of the drill string, the wellbore cleaning bit comprising:

a monolithic casing bit body having a proximal end configured for attachment to an end of a section of wellbore casing for tandem rotation therewith and further comprising a distal end portion which further comprises a distal end surface through which a longitudinal axis extends and a largest dimension located between said proximal and distal end portions to minimize sidetracking while cleaning the wellbore;

at least one cutting structure on an exterior surface of the casing bit body, which extends in a generally axial direction in multiple rows of cutters from said distal end surface to and beyond said largest dimension;

a shank having a distal end attached to the proximal end of the casing bit body and the proximal end attached to the distal end of the drill string.

10. The drilling system of claim 9, wherein the casing bit body comprises a wall having a wall thickness varying between about five percent (5%) and about forty percent (40%) of a largest diameter of the bit body.

11. The drilling system of claim 10, wherein the casing bit body comprises a wall having a wall thickness varying between about five percent (5%) and about fifteen percent (15%) of a largest diameter of the bit body.

12. The drilling system of claim 11, wherein the casing bit body comprises a wall having an interior surface having a shape configured to facilitate drilling through the body of the bit by another drill bit.

13. A method of forming a wellbore cleaning bit for cleaning at least a section of a wellbore, comprising attaching a proximal end portion of a monolithically-bodied casing bit configured for attachment to a section of wellbore casing for tandem rotation therewith to a shank having a connection portion configured for attachment to a drill string;

said casing bit further comprising a distal end portion which further comprises a distal end surface through which a longitudinal axis extends and a largest dimension located between said proximal and distal end portions to minimize sidetracking while cleaning the wellbore;

providing at least one cutting structure on an exterior surface of the casing bit body, said cutting structure which extends in a generally axial direction in multiple rows of cutters from said distal end surface to and beyond said largest dimension.

14. The method of claim 13, further comprising designing the proximal end portion of the casing bit for attachment to a distal end of a section of wellbore casing prior to attaching the proximal end portion of the casing bit to the shank.

15. A method of cleaning a wellbore, the method comprising:

coupling a proximal end of a shank to a drill string for tandem rotation therewith, the shank having a distal end attached to a proximal end of a monolithic casing bit body configured for attachment to a section of wellbore casing, said casing bit body comprising a distal end portion which further comprises a distal end surface through which a longitudinal axis extends and a largest dimension located between said proximal and distal end portions to minimize sidetracking while cleaning the wellbore;

providing at least one cutting structure on an exterior surface of the casing bit body, which extends in a generally axial direction in multiple rows of cutters from said distal end surface to and beyond said largest dimension; and advancing the casing bit body into a wellbore using a drill string.

16. The method of claim 15, further comprising designing the proximal end of the casing bit body for attachment to a distal end of a section of wellbore casing prior to attaching the proximal end of the casing bit body to the distal end of the shank.

* * * * *